US006369311B1

(12) United States Patent
Iwamoto

(10) Patent No.: US 6,369,311 B1
(45) Date of Patent: Apr. 9, 2002

(54) APPARATUS AND METHOD FOR GENERATING HARMONY TONES BASED ON GIVEN VOICE SIGNAL AND PERFORMANCE DATA

(75) Inventor: Kazuhide Iwamoto, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/602,166

(22) Filed: Jun. 22, 2000

(30) Foreign Application Priority Data

Jun. 25, 1999 (JP) ..... 11-180859

(51) Int. Cl.[7] ..... G10H 1/18; G10H 7/00

(52) U.S. Cl. ..... 84/615; 84/616; 84/619; 434/307 A

(58) Field of Search ..... 84/615, 616, 619, 84/624, 625, 634, 610; 434/307 A

(56) References Cited

U.S. PATENT DOCUMENTS 5,286,910 A 2/1994 Hasebe
5,446,238 A 8/1995 Koyama et al.
5,518,408 A * 5/1996 Kawashima et al. .... 434/307 A
5,712,437 A * 1/1998 Kageyama ..... 84/610
5,824,935 A * 10/1998 Tanaka
5,857,171 A * 1/1999 Kageyama et al.
5,876,213 A * 3/1999 Matsumoto ..... 434/307 A
5,939,654 A * 8/1999 Anada ..... 434/307 A X
6,121,531 A * 9/2000 Kato ..... 434/307 A X

* cited by examiner

*Primary Examiner*—Jeffrey Donels
(74) *Attorney, Agent, or Firm*—Morrison & Foerster LLP

(57) ABSTRACT

A harmony tone generating apparatus receives a voice wave signal bearing musical tone pitches such as a singer's or a speaker's human voice signal and a musician's instrumental voice signal, and plural kinds of performance data, each representing a musical note pitch, from plural kinds of performance sources. The latest received performance data from among the plural performance sources is captured and supplied to a harmony tone data generator, which in turn generates harmony tone data defining a tone pitch which is determined by the note pitch represented by the performance data. As the harmony tone data generator includes a limited number of data generation-channels, the limited number of the latest captured performance data pieces are assigned thereto for harmony data generation, truncating the oldest supplied performance data for new data assignment, where there is no empty channel left and newly captured performance data is supplied. A harmony voice signal will be produced with a tone pitch determined by the captured performance data and in a voice determined by the voice of the received voice wave signal. The original voice wave signal may be sounded in audible voice, and the performance data may be sounded in audible music.

21 Claims, 8 Drawing Sheets

Fig.2 Harmony Tone Generation (Main Routine)

*Fig. 3* Panel Control Setting

*Fig. 4* Vocal Harmony Setting

Fig. 5 Detecting Performance Data & Generating Tone Data (1)

Detecting Performance Data & Generating Tone Data (2)

Detecting Performance Data & Generating Tone Data (3)

*Fig. 8* Generating Harmony Tone
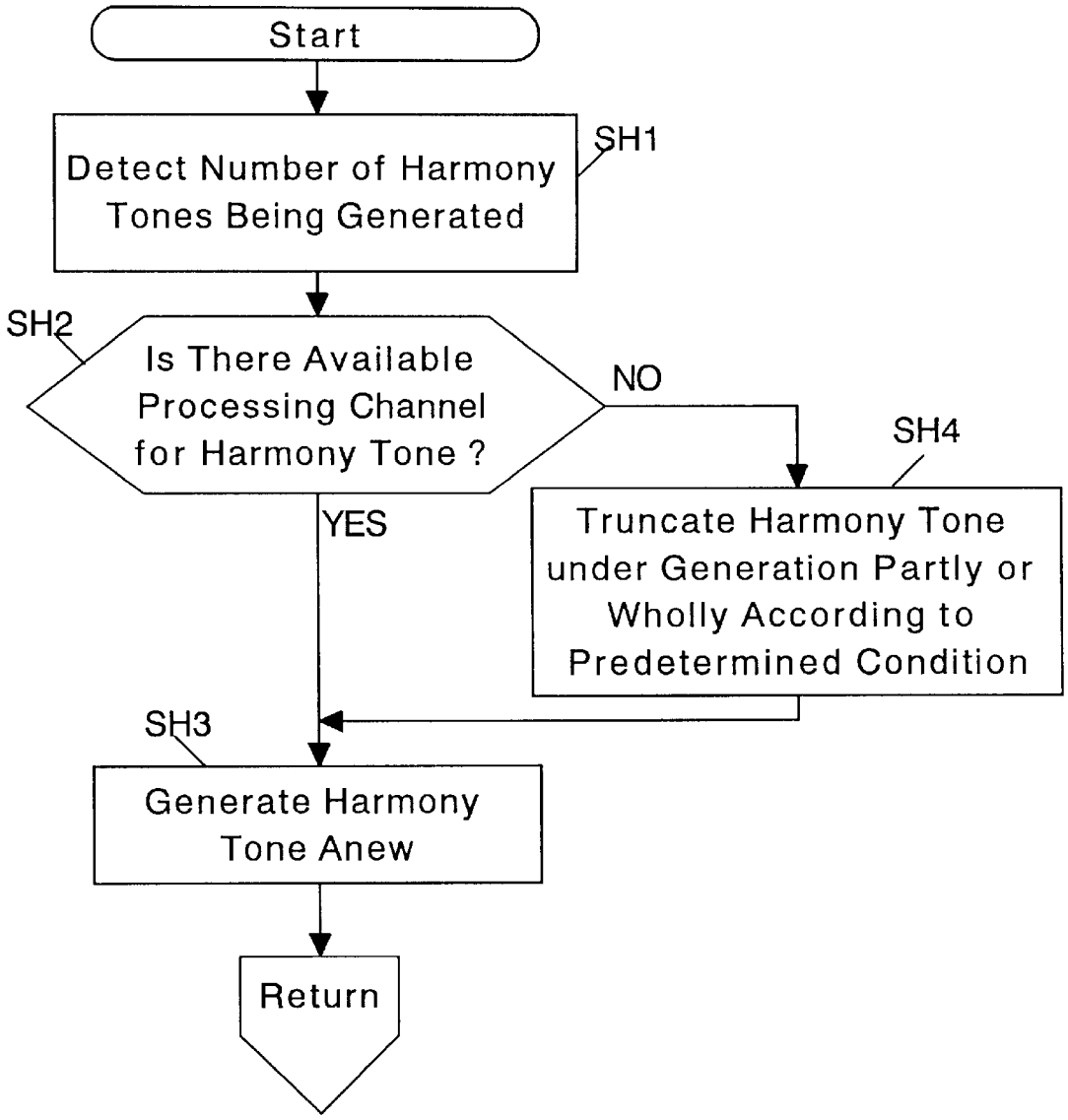

APPARATUS AND METHOD FOR GENERATING HARMONY TONES BASED ON GIVEN VOICE SIGNAL AND PERFORMANCE DATA

RELATED APPLICATION

This application claims priority from Japanese Patent Application No. 11-180859, filed Jun. 25, 1999, the contents of which are incorporated hereinto by this reference.

BACKGROUND OF THE INVENTION

1. Field of the Invention

The present invention relates to an apparatus and a method for generating harmony tones based on given voice signals and performance data, and more particularly to such an apparatus and a method in which a voice wave signal is given as a reference voice signal and performance data are inputted in plural kinds of performance data as note pitch designating data from plural kinds of performance devices and in which the pitch of the voice wave signal is modified based on the performance data, so that harmony voice tone signals are generated in a voice determined by the given voice wave signal and with tone pitches determined by the inputted performance data.

2. Description of the Prior Art

There have conventionally been known in the art such an apparatus of a data processing type as receives a voice wave signal and performance data and generates harmony voice tones in a voice determined by the voice wave signal and with tone pitches determined by the performance data. For example, where a singer's or a talker's human voice signal or a musician's instrumental voice signal is being inputted to the apparatus, a player designates note pitches or chords by manually performing music on a musical keyboard of the apparatus, and then the apparatus generates another voice signal whose voice (timber) is determined by the inputted human voice or instrumental voice and whose tone pitch is determined by the performance data representing the player-designated note pitch or chord, thus the generated voice signal make a harmony voice with respect to the inputted voice. An example of such an apparatus has a vocal harmony function operating in a vocoder harmony mode and/or in a chordal harmony mode. Under the vocoder harmony mode, when a voice signal is given such as by singing a song, speaking words or playing a musical instrument, and concurrently the keys on the musical keyboard are manipulated, the apparatus produces a harmony tone in the voice of the inputted voice but with such different pitches than the given voice as are designated by the manipulated key in the keyboard. Under the chordal harmony mode, when a voice signal is given and a chord is played on the keyboard, the apparatus recognizes the played chord and produces harmony tones in the voice of the inputted voice but with pitches of the chord constituent notes. The generated harmony tones may be produced as musical sounds together with the original voice sound to present harmonious sensation, or may be produced alone as musical sounds to present a second melody line with respect to the original melody line. The second melody line thus produced will give harmonious sensation if performed afterward simultaneously with the original melody line, and therefore may be termed as a harmony melody line.

There have conventionally been known in the art various types of musical tone producing apparatus from the viewpoint of performance data supply, such as a type in which the performance data are inputted or supplied by manipulating keys in a keyboard for a direct real time performance, a type in which the performance data are obtained by reading out recorded performance data from an automatic performance data storage device, and a type in which the performance data are received from an external MIDI apparatus or other musical apparatus connected to the musical tone producing apparatus. But, there has never been known in the art, as far as the inventor is aware of, a musical tone producing apparatus in which a limited number of resources such as harmony tone generating channels are used concurrently in common to a plurality of different performance data supplying modules to generate harmony tones.

On the contrary, with a known type of musical tone producing apparatus having a function of generating harmony tones, a particular performance channel is fixedly assigned for designating tone pitches of the harmony tones to be produced. This type of apparatus is not flexible in harmony addition according to various performance data from various performance channels. Further, even though there may be provided some increased number of harmony tone generating channels, there may be a situation in which not all the intended harmony tones are generated or even some of the designated performance tones will not be generated, in case there are supplied performance data (pitch designating data) of too many performance notes in excess of a given number of tone generating channels.

Further, generation of harmony tones or the like will require the provision of such exclusive function modules in the apparatus, and hence the provision of so many of such special modules is hardly permitted for an apparatus of the normal size system configuration.

SUMMARY OF THE INVENTION

It is, therefore, a primary object of the present invention to solve the above-mentioned drawbacks involved in such a conventional apparatus or method of generating harmony tones and to provide improved music performing apparatus and method having a harmony tone generating function capable of generating harmony tones concurrently responsive to a plurality of different types of performance data supplying fashions such as a manual performance on a music playing keyboard containing manipulating keys for music performance, an automatic performance by reading out the stored music performance data from a storage device, and an externally controlled performance by MIDI data supplied from an external musical device so that harmony tone generation can be surely conducted in well balanced response to plural types of performance data flexibly.

In order to accomplish the object of the present invention, the invention provides a harmony tone generating apparatus comprising: a voice signal input module which receives a voice wave signal bearing tone pitches; a performance data input module which receives plural kinds of performance data from plural kinds of performance sources, the performance data containing plural data pieces, each defining a musical note having a pitch; a performance data capture module which captures a performance data piece that has been received latest among the data pieces contained in the performance data received from the plural kinds of performance sources; and a harmony tone data generating module which generates harmony tone data representing a tone pitch determined by the note pitch defined by the data piece as captured by the performance data capture module to be used for generation of harmony voice signal with respect to the received voice wave signal.

The present invention further provides a storage medium for use in an apparatus for generating harmony tones, the apparatus being of a data processing type comprising a computer, the medium containing a program that is executable by the computer, the program comprising: a module of receiving a voice wave signal bearing tone pitches; a module of receiving plural kinds of performance data from plural kinds of performance sources, the performance data containing plural data pieces, each defining a musical note having a pitch; a module of capturing a performance data piece that has been received latest among the data pieces contained in the performance data received from the plural kinds of performance sources; and a module of generating harmony tone data representing a tone pitch determined by the note pitch defined by the data piece as captured by the performance data capture module to be used for generation of harmony voice signal with respect to the received voice wave signal.

The present invention still further provides a method for generating harmony tones comprising: a step of receiving a voice wave signal bearing tone pitches; a step of receiving plural kinds of performance data from plural kinds of performance sources, the performance data containing plural data pieces, each defining a musical note having a pitch; a step of capturing a performance data piece that has been received latest among the data pieces contained in the performance data received from the plural kinds of performance sources; and a step of generating harmony tone data representing a tone pitch determined by the note pitch defined by the data piece as captured by the performance data capture module to be used for generation of harmony voice signal with respect to the received voice wave signal.

The harmony tone data means in the context of the present invention the data which define tone pitches for the harmony voice wave signal to be generated in a voice determined with reference to the voice of the inputted voice wave signal, i.e. of the human voice or of the instrumental voice. The harmony tone data are generated by harmony tone data generating channels provided in the harmony tone generating module other than performance tone generating channels provided in the apparatus for processing the performance tones being designated by the performance data from the performance sources. The harmony tone data generating channels may include a function of generating harmony voice signals as integral processing channels, or there may be provided separate circuits for generating harmony voice signals receiving the harmony tone data from the harmony tone generating channels.

The harmony tone data generating channels may be assigned to the performance data pieces under the correspondence of one channel per captured performance data piece so that one harmony voice will be generated in response to one note designation from the performance source, or alternatively under the correspondence of plural channels per captured performance data piece so that plural harmony voices will be generated in response to one note designation from the performance source. In the latter correspondence, the number of captured performance data pieces which can determine the tone pitches of the harmony tones will be limited to the number which is obtained by dividing "the number of channels provided in total" by "the number of channels assigned per captured performance data piece." There may be provided some preferential conditions for capture among plural kinds of performance sources where there may be inputted performance data from different kinds of performance sources concurrently.

A typical example of harmony tone generation according to the present invention may be the generation of harmony voice wave signals in which a singer's human voice wave signal is inputted to the apparatus from an external source such as a microphone and a record player and then a player manipulates the musical playing keyboard to designate notes in performance to generate a harmony voice wave signal bearing tone pitches determined by the designated notes and a timber determined by the singer's voice. Examples of the harmony voice generation are a vocoder type of voice generation and a chordal type of voice generation. The voice wave signal inputted from external devices may be human voices (singing a song or speaking words), musical instrument voices under live performance, any kind of sounds from the natural world, or any artificial sound signals and may be supplied from a microphone or any audio playback device in the form of analog signals. The voice of the harmony tones are in the same timber as the supplied voice or in a different (modified) timber than the supplied voice.

The present invention may be provided with a pitch shift function of harmony tone generation in which the harmony tones will be generated by shifting the tone pitches of the inputted voice wave signal irrespective of the performance data supplied from the performance sources. The pitch shift function includes a chromatic harmony mode in which the harmony tones will have tone pitches which are deviated from the pitches of the inputted voice signals by a predetermined amount of note interval and a detuned harmony mode in which the harmony tones will have tone pitches which are slightly deviated from the pitches of the inputted voice signals.

According to the present invention, at least two different kinds of performance data are inputted concurrently from different kinds of performance sources. For example, key-played performance data from a keyboard and externally derived performance data such as automatic performance data from a storage device and live performance data from an external musical instrument connected to the external input terminal of the apparatus of the present invention. In such a situation, the performance data pieces supplied from those plural performance sources will be captured instantaneously over the plural sources in common, and the latest captured ones are assigned to the available channels for the harmony tone data generation in a latest-preferred fashion to determine the tone pitch of the harmony tones to be generated concurrently. The harmony tone data generator includes a limited number of data generation channels, a limited number of the latest captured performance data pieces are assigned thereto for harmony data generation, truncating the oldest supplied performance data for new data assignment, where there is no empty channel left and newly captured performance data is supplied. For example, there are provided two harmony tone data generating channels, and two latest performed notes are captured to be assigned to the two harmony tone data generating channels to determine the pitches of two harmony tones to be generated. Harmony voice signals will be produced, by means of a voice signal synthesizer, with the tone pitches determined by the captured performance data and in a voice determined by the voice of the received voice wave signal. The original voice wave signal may be sounded in audible voice by means of a conventional audio signal processing device, and the performance data may also be sounded in audible music by means of a conventional tone generator.

Thus, a number of (for example, two) kinds of performance data from different performance sources such as automatic performance data read out from a storage device, manual performance data from a keyboard and music data supplied from an external apparatus can control the generation of harmony tones to generate harmony tones responsive to more than one performance data input concurrently with a simple configuration. Among the performance data from the different performance sources, a predetermined number of latest arrived note data pieces are captured to be used for determining the tone pitches of the harmony tones to be generated, irrespective of the differences in source kind. While the harmony tone generation will require the provision of special circuits or devices exclusively assigned thereto, and hence not so many of such circuits or devices can be provided from an economical point of view, the preferential capture of a limited number of performance notes will avoid such an economical disadvantage. And harmony tones under well balanced control by the performance sources can be realized.

In a preferred embodiment of the present invention, the number of harmony tone data generating channels and the number of latest captured notes from the performance sources are made equal to each other. For example, there are provided two harmony tone data generating channels, and the performance capture module is made to capture two latest performance notes. Where a certain harmony tone is being generated in response to a certain inputted performance note and there comes another performance note which will cause a harmony tone of the same tone pitch as such a certain harmony tone which is being generated, no new assignment will be made and the same harmony tone will be continued to be generated.

In another aspect of the present invention, plural harmony tone data generating channels are assigned to one note of the performance data so that the performance data representing one performed note will determine the pitches for plural harmony tones to be generated. In such a situation, the number of latest captured notes from the performance sources to be used to determined the pitches of the harmony tones to be generated will be determined by the number of such channels in total divided by the number of harmony tones to be generated per captured note. Further, in case a large plurality of performance notes are designated by the performance data from plural kinds of performance sources and there are not provided a sufficient number of harmony tone data generating channels for all of the designated notes, the notes to be captured for determining harmony tones will be employed from the supplied performance notes according to a predetermined preferential rule (priority order). Such a preferential capture from among plural kinds of performance sources will provide the well balanced generation of the harmony tones among the performance sources.

According to the present invention, the timbers of the harmony tones to be generated are determined by a reference voice signal which is an voice wave signal inputted externally from, for example, a microphone, while the pitches of the harmony tones to be generated are determined by the performed notes as represented by the performance data derived from different kinds of performance sources. Accordingly, harmony voices under the "vocoder type" control (in which the tone pitches of the harmony voices are determined according to the respective pitches of the performance notes) and those under the "chordal type" control (in which the tone pitches of the harmony voices are determined through a lookup table according to the chord designated by the chord performance) can be generated in response to variety of performance sources including a musical keyboard, a music data storage device and various kinds of external musical apparatuses, which will present variety of favorable vocal harmony tones.

According to the present invention, the apparatus can comprise a further type of harmony tone generation mode such as a chromatic harmony in which the pitches of the harmony tones are made to be a predetermined note interval (e.g. four semitones) apart from the pitch of the original voice signal and a detuned harmony in which the pitches of the harmony tones are made to be slightly (e.g. five cents) apart from the pitch of the original voice signal.

As will be understood from the above description about generating harmony tones, a sequence of steps each performing the operational function of each of the structural element modules of the harmony tone generating apparatus will constitute an inventive method for generating harmony tones according to the spirit of the present invention.

Further as will be understood from the above description about the apparatus and the method for generating harmony tones, a storage medium containing a program executable by a computer system, which program comprising program modules for executing a sequence of the processes each performing the operational function of each of the structural element modules of the above harmony tone generating apparatus or performing each of the steps constituting the above harmony tone generating method will reside within the spirit of the present invention.

Further as will be apparent from the description herein later, some of the structural element modules of the present invention are configured by a computer system performing the assigned functions according to the associated programs. They may of course be hardware structured discrete devices performing the same functions.

The present invention may take form in various components and arrangement of components including hardware and software, and in various steps and arrangement of steps. The drawings are only for purposes of illustrating a preferred embodiment and processes, and are not to be construed as limiting the invention.

BRIEF DESCRIPTION OF THE DRAWINGS

For a better understanding of the present invention, and to show how the same may be practiced and will work, reference will now be made, by way of example, to the accompanying drawings, in which:

FIG. 8 is a flow chart showing an example of subroutine processing for generating harmony tones as executed in the processing of FIGS. 6 and 7.

DESCRIPTION OF THE PREFERRED EMBODIMENTS

Hardware Configuration

Figure 1:
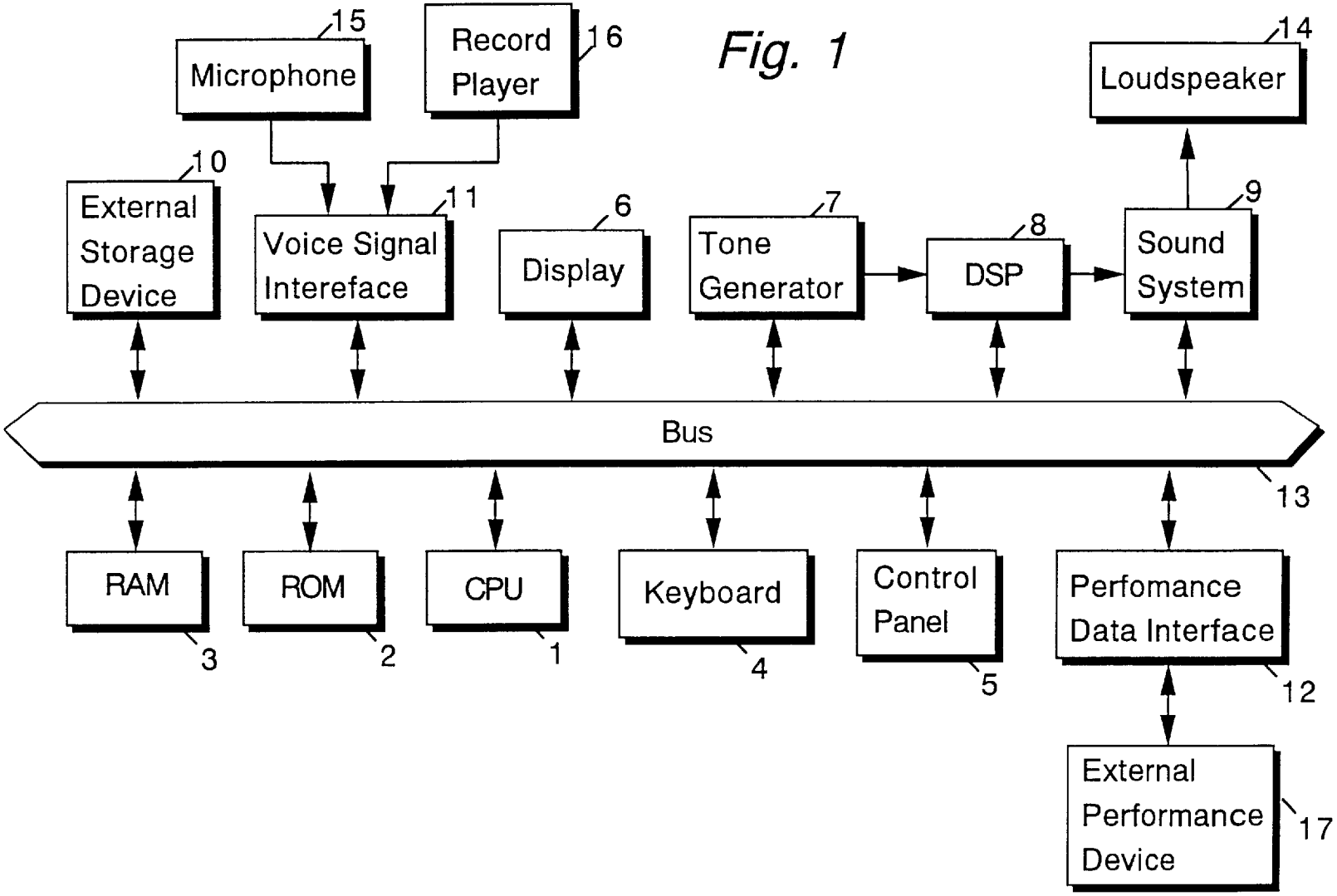
FIG. 1 is a block diagram showing a hardware structure of an example of a harmony tone generating apparatus according to the present invention.

FIG. 1 shows a general block diagram of an example of the hardware structure of a music performing system which includes a harmony tone generating apparatus according to the present invention and executes a harmony tone generating program according to the present invention.

Referring to FIG. 1, the performance system comprises a CPU (central processing unit) 1, a ROM (read only memory) 2, a RAM (random access memory) 3, a manipulating keyboard device 4, a control panel 5 including various control elements, a display device 6, a tone generator 7, a DSP (digital signal processor) 8, a sound system 9, an external storage device 10, a voice signal interface 11 and a performance data interface 12, all being interconnected by means of bus lines 13.

The CPU 1 is to control various operations according to associated programs, and especially is to centrally execute tone data processing including processing of performance data from performance sources and harmony tone data to be generated as well as various setting for and formation of vocal harmony tones. The ROM 2 stores prescribed programs to control the system, and the programs contain various process executing programs and various lookup tables and data bases for handling the performance data and the harmony tone data according to the present invention. The RAM 3 serves as work areas for temporarily storing data and parameters, registers and flags, and intermediate data necessary for the above processing.

The keyboard 4 includes manipulating keys and may preferably be divided into plural keyboard regions, each covering a fractional key range (note range). In the present system, the keyboard 4 serves as one of the performance data source which supplies performed note data according to the player's key manipulation and delivers note designating data. When these note designating data are inputted into the system for generating harmony tones as the performance data while a voice wave signal is being inputted, the system operates to generate harmony tone data in a vocal harmony mode designating tone pitches determined by the note designating data. The harmony tone data in turn causes harmony voice signals of the designated tone pitches to be generated in a timber determined by the inputted voice wave signal. For example, the performance data from a particular keyboard region (i.e. a right hand fraction of the keyboard) will cause the generation of harmony voices under the vocoder type operation.

The control panel 5 includes various control elements for setting various operation modes, parameters, selections, etc. The display device 6 includes a display screen and various indicators, which may be juxtaposed to the control elements on the control panel 5. The tone generator 7, the DSP 8 and the sound system 9 constitute a musical tone output section to emit musical sounds from a loudspeaker 14.

Among the control elements on the control panel 5, there are an accompaniment mode select button, a playback mode select button, an effect mode select button, a vocal harmony type set button, a chord detection mode set button (or dial), ten-key buttons for entering numbers to designate an accompaniment mode, an automatic accompaniment on/off button, a start/stop button, etc. The user can designate a type of vocal harmony mode from among the vocoder harmony mode and the chordal harmony mode by manipulating the vocal harmony type set button, and further can designate automatic selection of harmony generation type which causes the automatic selection of the harmony generation type depending on which of the accompaniment mode and the playback mode is selected.

The external storage device 10 may be a hard disk drive (HDD) or a CD-ROM drive or else, and stores control programs and various data. Where the ROM 2 does not store the control programs, the HDD is used to store the necessary control programs so that the programs are transferred to the RAM 3 from the HDD, thus enabling the CPU 1 to conduct data processing in a similar quick manner as the case where the ROM 2 stores the control program. A CD-ROM drive or other ROM media drives may provide control programs and various data, and such control programs and various data may be transferred to the hard disk medium in the HDD. Or alternatively, the control programs and various data may be downloaded from an external server computer via a communication interface (both not shown) to store into the hard disk in the HDD. This method will facilitate the addition and/or up-grading of the control program. Where the storage device 10 includes a CD-ROM drive and/or a floppy disk drive (FDD) and permits input of performance data from portable storage media such as commercial CD-ROMs and floppy disks of arbitrary protocol (format) storing music albums in automatic performance data. Where such performance data from a music album are read out from the external storage device 10 as one of the performance sources in this system, the read out data constitute one kind of input performance data in the form of automatic performance data. Thus the system can present a music performance in a vocal harmony mode based on the automatic performance data, outputting the automatic performance tones together with the generated harmony tones. Other than the CD-ROM and the floppy disk, the storage medium may be a magneto-optical disk (MO) and other various type media, and then the performance data generated in the present system can also be stored back into such media.

The voice signal interface 11 has an A/D (analog to digital) converting function and thereto are connected a microphone 15 for picking up sounds such as human voices (singing or speaking) and instrument voices, and a record player 16 of an analog output type such as a CD player and a cassette tape player. Under the vocal harmony mode, when a human voice wave signal from the microphone 15 or an analog musical wave signal (either human or instrumental voice) played back from the record player 16 is inputted to the system via the voice signal interface 11, the system operates to generate harmony voices with respect to these inputted voices.

The performance interface 12 is to transfer performance data in the MIDI format or other data format different from the format of this system between the system and external performance devices 17 such as a musical tone data playback device, an external sequencer, a computer and an electronic musical instrument connected to the system. The performance interface 12 receives musical tone signals from such an external musical apparatus 17 as one of the performance sources and serves to input "external performance data" to the system so that the system can realize a musical performance based on the external performance data under the vocal harmony mode.

The music performing system of the present invention can be embodied in the form of an electronic musical instrument and also can be configured by using a personal computer (PC). The invention is also applicable to various types of musical tone playback apparatuses and music performing apparatuses for adding harmony voices, and to karaoke apparatuses and game machines for producing special sound effects as well.

Main Routine Processing

Figure 2:
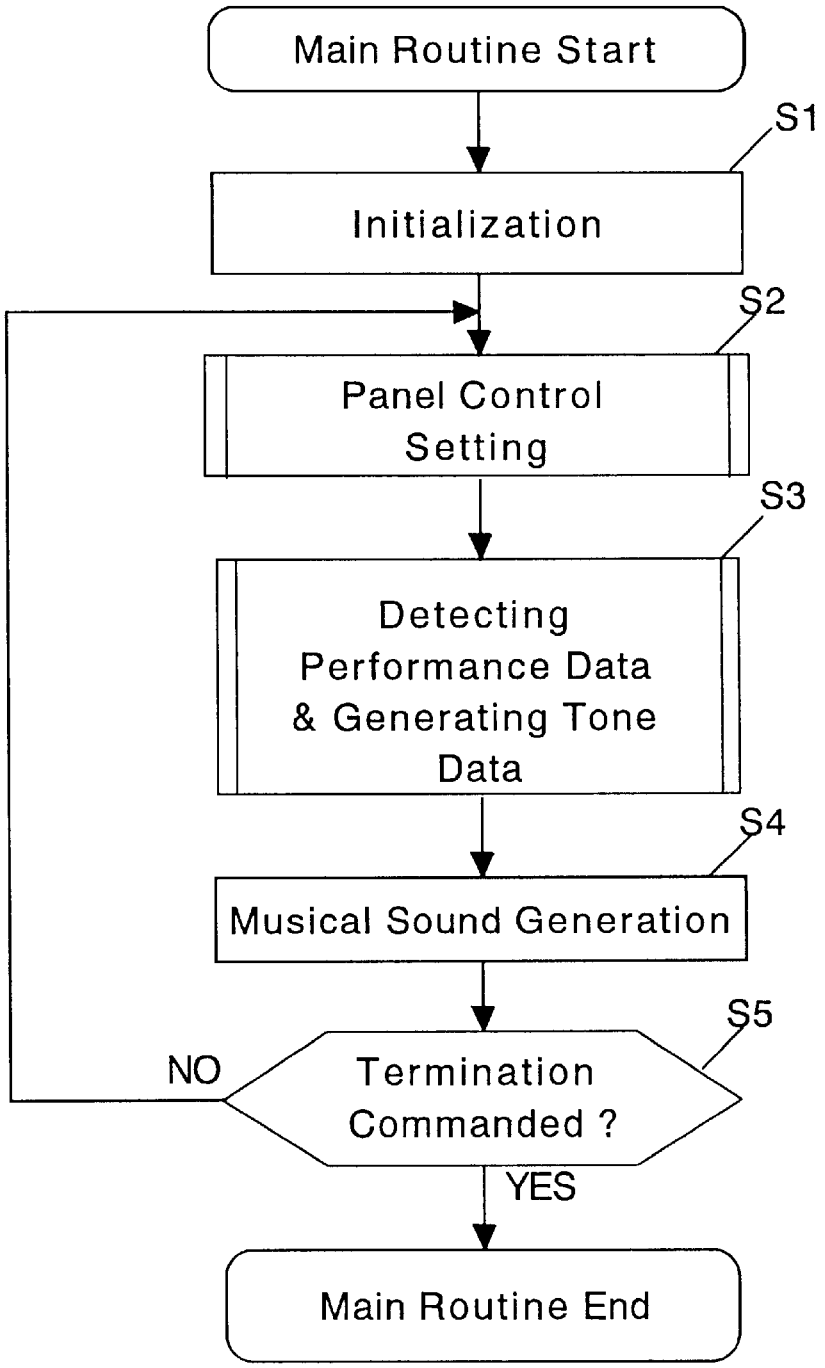
FIG. 2 is a flow chart showing an example of main routine processing for generating harmony tones according to the present invention.

FIG. 2 shows the flow chart of the main routine illustrating the overall processing of the performance data for generating harmony tones in an embodiment of the present invention. As the main routine starts, a step S1 conducts initialization of the system. A step S2 is then for setting the panel controls to set the modes and parameters according to the manipulating knobs and switches provided in the control panel 5. A step S3 is to detects performance data from various performance sources such as keyboard performance data obtained from the keyboard device 5 in response to the manipulation of the keys, automatic performance data read out from the external storage device 10, and voice signals as inputted from the microphone 15 or played back from the record player 16 to generate harmony tone data representing tone pitches which are determined by the detected performance data from the performance sources in accordance with the mode and the parameters as set in the control panel 5 or sometimes as changed according to a predetermined condition.

A step S4 generates, utilizing the DSP 8, harmony voice wave signals in a timbre (voice quality or tone color) determined with reference to (the same as or modified from) the timber of the voice signals inputted from the microphone 15 or the record player 16 and with tone pitches designated by the above generated harmony tone data. The input voice signals from the microphone 15 may be human voices of a singer or of a speaker, and may be instrumental voices of a musical instrument. The voice signals from the record player 16 may also be human voices and may be instrument voices. The step S4 also serves to generate, utilizing the tone generator 7, voice wave signals (tone signals) of the performed musical tones as designated by the performance data from above various performance sources. Both the generated voice wave signals will be outputted as audible sounds in the air through the sound system 9 and the loudspeaker 14. The processing through the step S2–S4 will be repeated in a loop until a termination of the main routine will be commanded at a step S5.

According to the main routine of FIG. 2, a user of the apparatus, i.e. an operator of the system first sets the modes and the parameters for the harmony tone generation and/or the automatic performance by manipulating the control knobs and switches in the control panel 5 in the step S2. Then, performance data will be inputted from plural kinds of performance sources according to the manipulation of the keys in the keyboard 4, the reading out of the automatic performance data from the external storage device 10, and the musical performance on the external performance device 17. As a voice signal is inputted from the microphone 15 or from the record player 16, tone data will be generated in accordance with the set modes and parameters to provide harmony tones and musical tones. In case the vocal harmony type is set at the step S2, the processing at the step S3 may handle performance data with priority given to at least two latest arrived notes over others in generating tone data so that harmony tone data for at least two harmony voices can be generated concurrently based on the timbre of the inputted voices or the played back voices responsive to performance data from at least two performance sources.

Panel Control Setting

Figure 3:
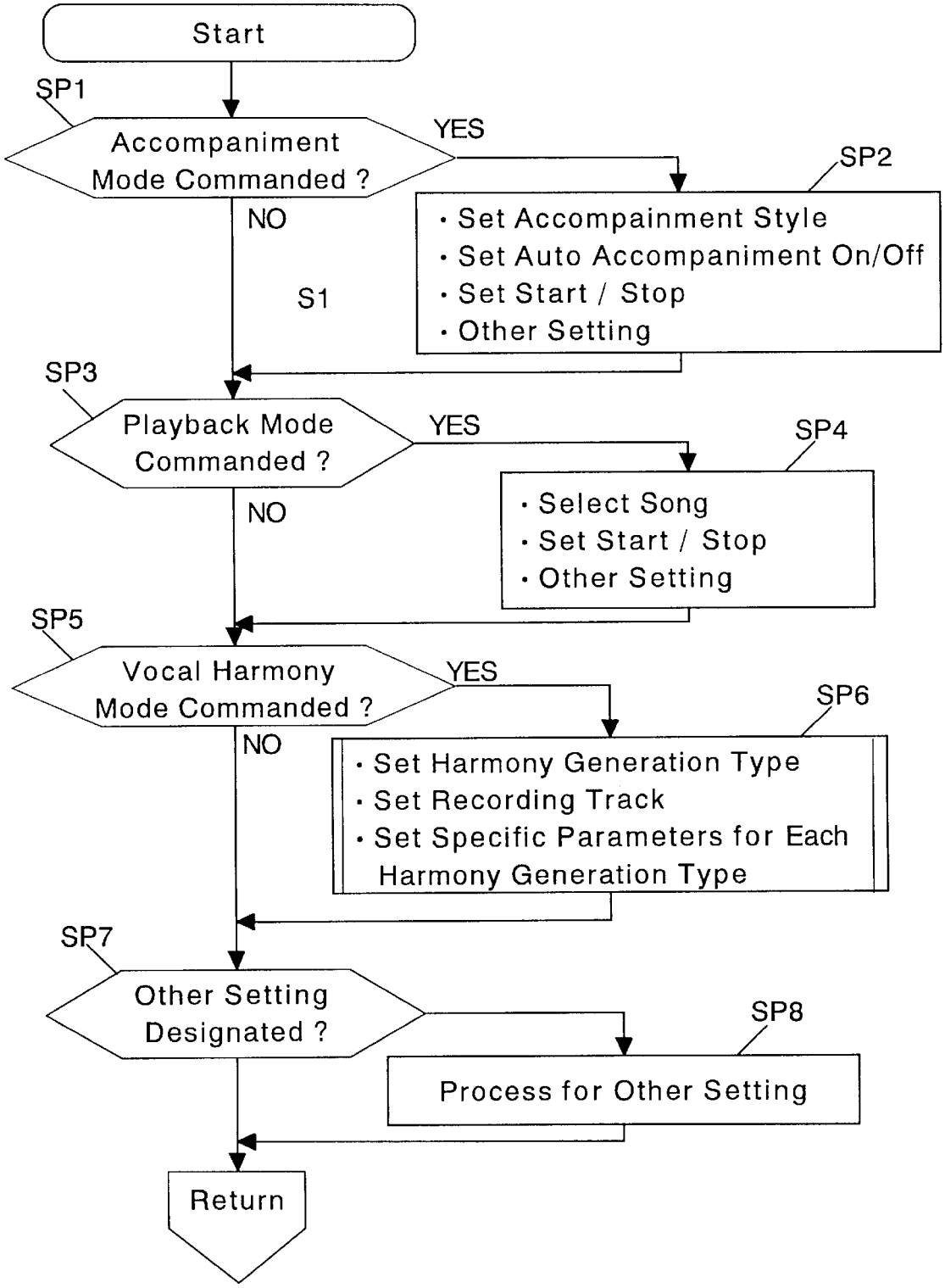
FIG. 3 is a flow chart showing an example of subroutine processing for panel control setting as executed in the main routine processing of FIG. 2.

FIG. 3 shows a flow chart of an example of subroutine processing for panel control setting as executed at the step S2 in the main routine processing of FIG. 2. A step SP1 judges whether the accompaniment mode is commanded. Where the accompaniment mode command button is actuated in the control panel 5 to designate the "accompaniment mode", the process moves forward to a step SP2, and if otherwise, to a step SP3. The step SP2 is to set accompaniment styles of various music genres (e.g. 8-beat pops, dance pops), to set automatic accompaniment on/off, to set start/stop, and to set other matters according to the conditions as set by the corresponding setting buttons and keys. The step SP3 judges whether the playback mode is commanded. Where the playback mode command button is actuated in the control panel 5 to designate the "playback mode", the process moves forward to a step SP4, and if otherwise, to a step SP5. The step SP4 is to select songs (musical pieces) to be played back, to set start/stop, and to set other matters according to the conditions as set by the corresponding setting buttons and keys. The song titles or numbers may be selectively designated from among the song data recorded on a floppy disk or else equipped in the external storage device 10. Such a floppy disk may be a song data disk on the market.

The step SP5 judges whether the vocal harmony mode is commanded with various parameters therefor are being designated. Where the various parameters for the vocal harmony mode are to be set or to be edited by manipulating the vocal harmony setting buttons on the control panel 5, the process moves forward to a step SP6, and if not, to a step SP7. The step SP7 is a subroutine for setting various parameters for the vocal harmony mode including harmony generation type (vocoder type or chordal type) and its automatic selection, recording tracks for vocal harmony tone data and further specific parameters for each harmony generation type according to the conditions as set by the corresponding setting buttons and keys. The setting in the step SP6 includes nomination of a particular performance source to derive performance data input to the apparatus to determine the tone pitch of the harmony tone to be actually generated. Under the initial condition of the apparatus after the system initialization, all of the performance sources are made available for determining the tone pitches of the harmony tones as long as the tone processing channels can be secured among the structural resources. The step SP6 may include such setting for limiting the available performance source. For example, five channels of the keyboard performance data and the automatic performance data are allotted for determining the tone pitches of the harmony tones to be generated.

The step SP7 judges whether other settings are designated. If the judgment is affirmative (YES), the process moves forward to a step SP8 to set other matters, and if not, the process returns to the main routine of FIG. 2 to proceed to the step S3 for detecting performance data and generating tone data.

Vocal Harmony Setting

Figure 4:
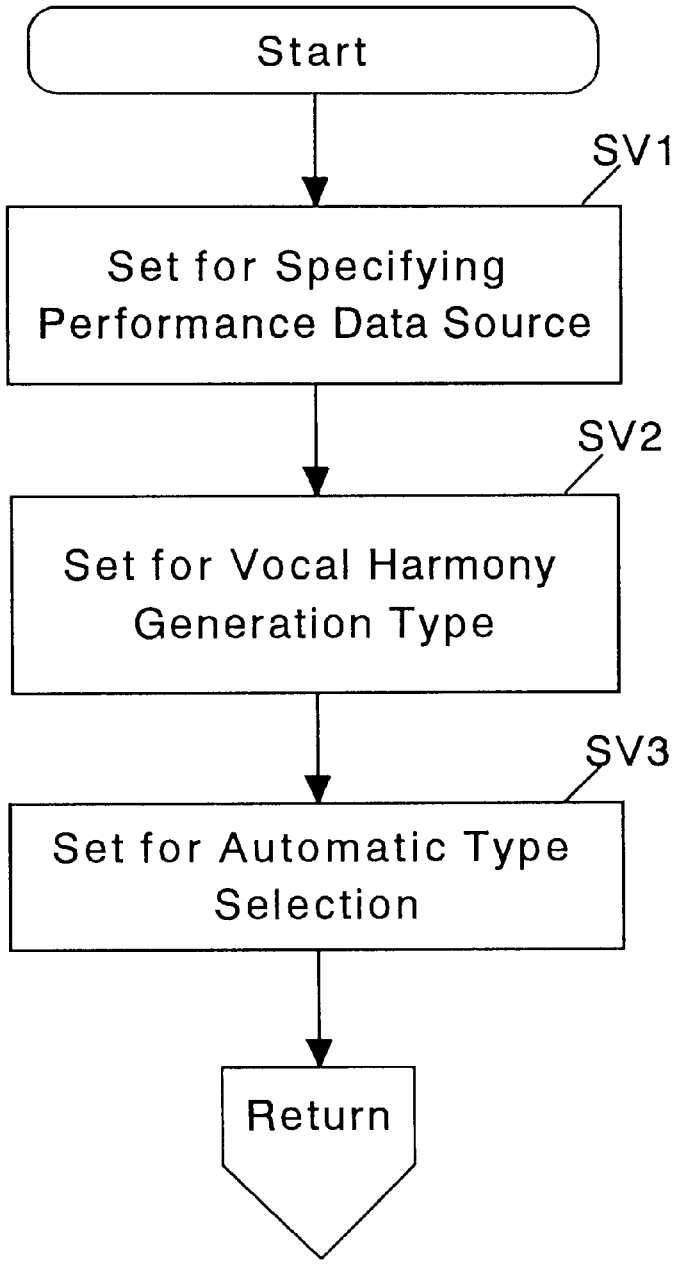
FIG. 4 is a flow chart showing an example of subroutine processing for vocal harmony setting as executed in the subroutine processing of FIG. 3.

FIG. 4 shows a flow chart of an example of subroutine processing for vocal harmony setting as executed at the step SP6 in the subroutine processing of FIG. 3. A step SV1 in this subroutine executes the following settings to specifically nominate the performance data source from which the performance data should be derived for the vocal harmony control:

(1) particular key range in the keyboard device 4;

(2) kind of the external performance device 17, and particular channel through which the performance data are derived from the external performance device 17;

(3) kind of the automatic performance data read out from the external storage device, and particular channel through which the automatic performance data are derived; etc.

With respect to a particular type of automatic performance data, the data channel for the vocal harmony control can be specifically nominated by means of a special identifier contained in the data so that the derivation of the performance data for the vocal harmony control can be automatically determined by detecting the specific identifier contained in the data. For example, in some type of recorded media of automatic performance data or in some protocol of such recording, controlling data for the vocal harmony tones are recorded on a specific record track. With such a type of recorded data, automatic setting of the vocal harmony control channel can be made accordingly. In the case of a recorded medium of automatic performance data containing a special identifier for the purpose of a copyright, the automatic channel setting for the vocal harmony tone processing can be easily conducted.

A step SV2 is to set the type of the vocal harmony mode (vocoder harmony type or chordal harmony type) to be employed and to set specific parameters in detail for the respective vocal harmony types. A step SV3 is to set for automatic type selection whether the automatic selection of the vocal harmony type (i.e. vocoder type or chordal type) is used depending on the selection of the accompaniment mode or the playback mode, or not. Then the process returns to the step SP7 in the panel control setting routine of FIG. 3.

The types of the vocal harmony mode available in the apparatus of the present invention are to be designated at the step SV2 of FIG. 4, and include a vocoder harmony generation in which harmony tones are produced having pitches as designated by the note pitches represented by the performance data, for example, from the keyboard 4, a chordal harmony generation in which harmony tones are produced having pitches of chord constituent notes as designated by the chord performance in the automatic accompaniment keyboard region or by the chord data contained in the automatic performance data, a chromatic harmony generation in which harmony tones are produced having pitches which is deviated from the tone pitch of the inputted voice wave signals from the microphone 15 or the record player 16 by an amount of a predetermined note interval (e.g. three semitones), and a detuned harmony generation in which harmony tones are produced having pitches which is slightly shifted from the tone pitch of the inputted voice wave signals from the microphone 15 or the record player 16, for example by an amount of a few cents or a fraction of one Hz.

The specific parameters to be set in detail at the step SV2 may include various parameters, for example, for mainly producing the harmony voices by lowering the signal level of the inputted voice wave signal to realize a harmony tone enhanced performance, or for producing the harmony voices by changing male/female nature to realize a gender change function, or for compensating the pitches of the inputted voice. For easy selection or designation of those parameters on the screen of the computer display, icons or graphical marks which adequately imply the respective designation parameters may preferably be employed and exhibited on the screen so that the user can operate the apparatus in the currently prevailing manner in the computer field. Novice users will then easily use the apparatus understanding the available conditions and functions in the apparatus.

Performance Data Detection & Tone Data Generation

Figure 5:
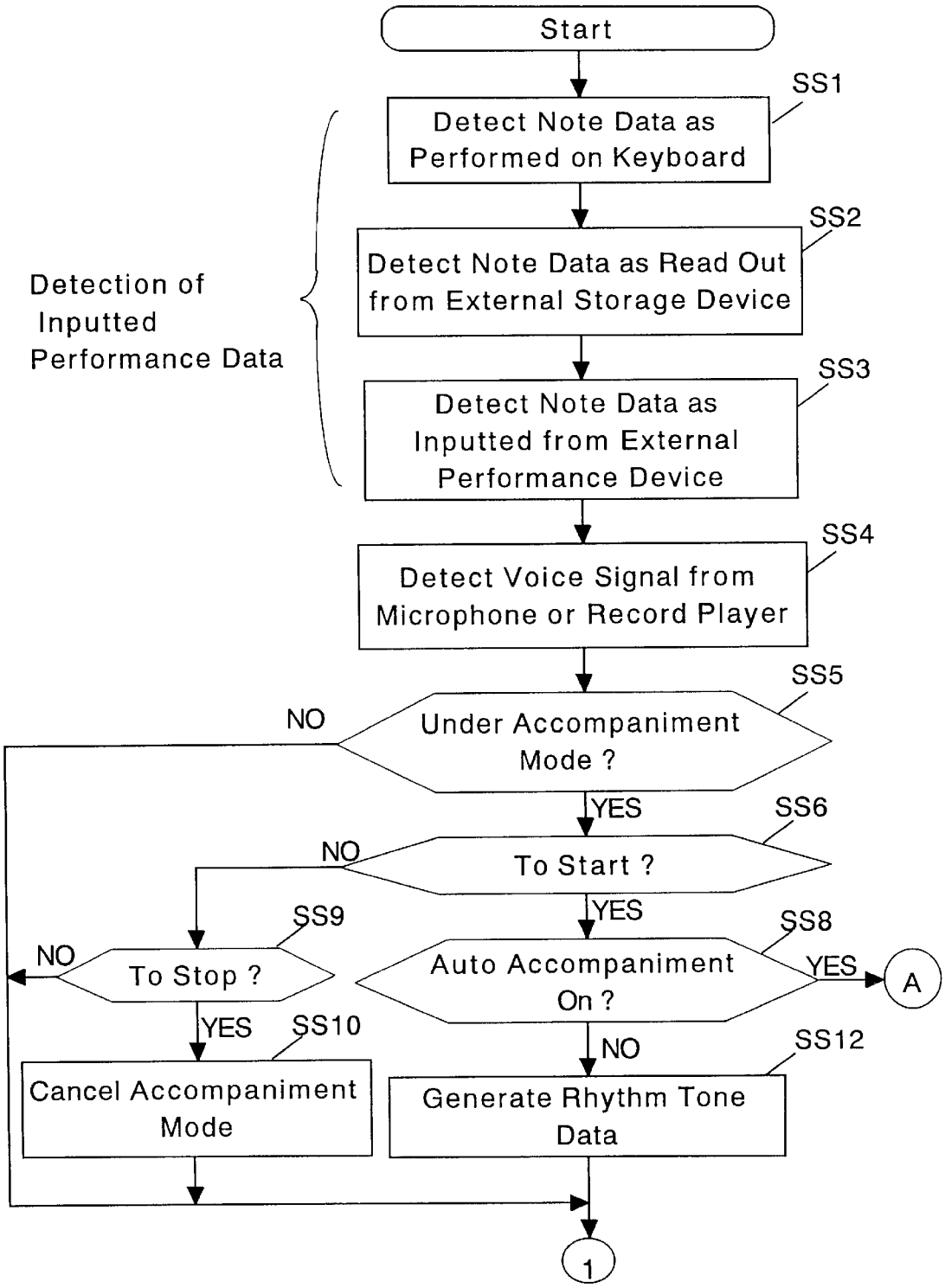
FIGS. 5, 6 and 7 are, in combination, a flow chart showing an example of subroutine processing for detecting performance data and generating tone data as executed in the main routine processing of FIG. 2.
Figure 6:
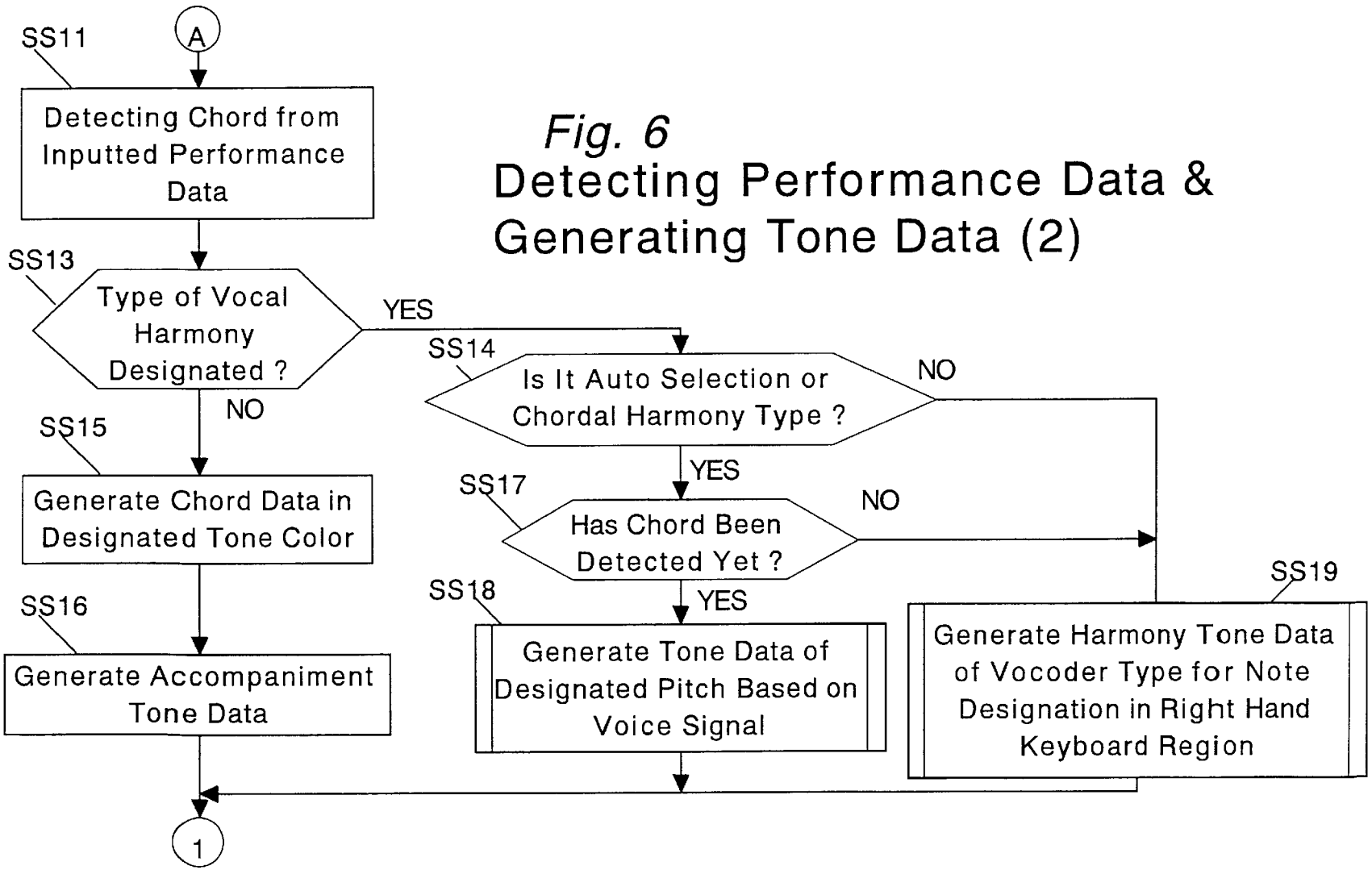
Figure 7:
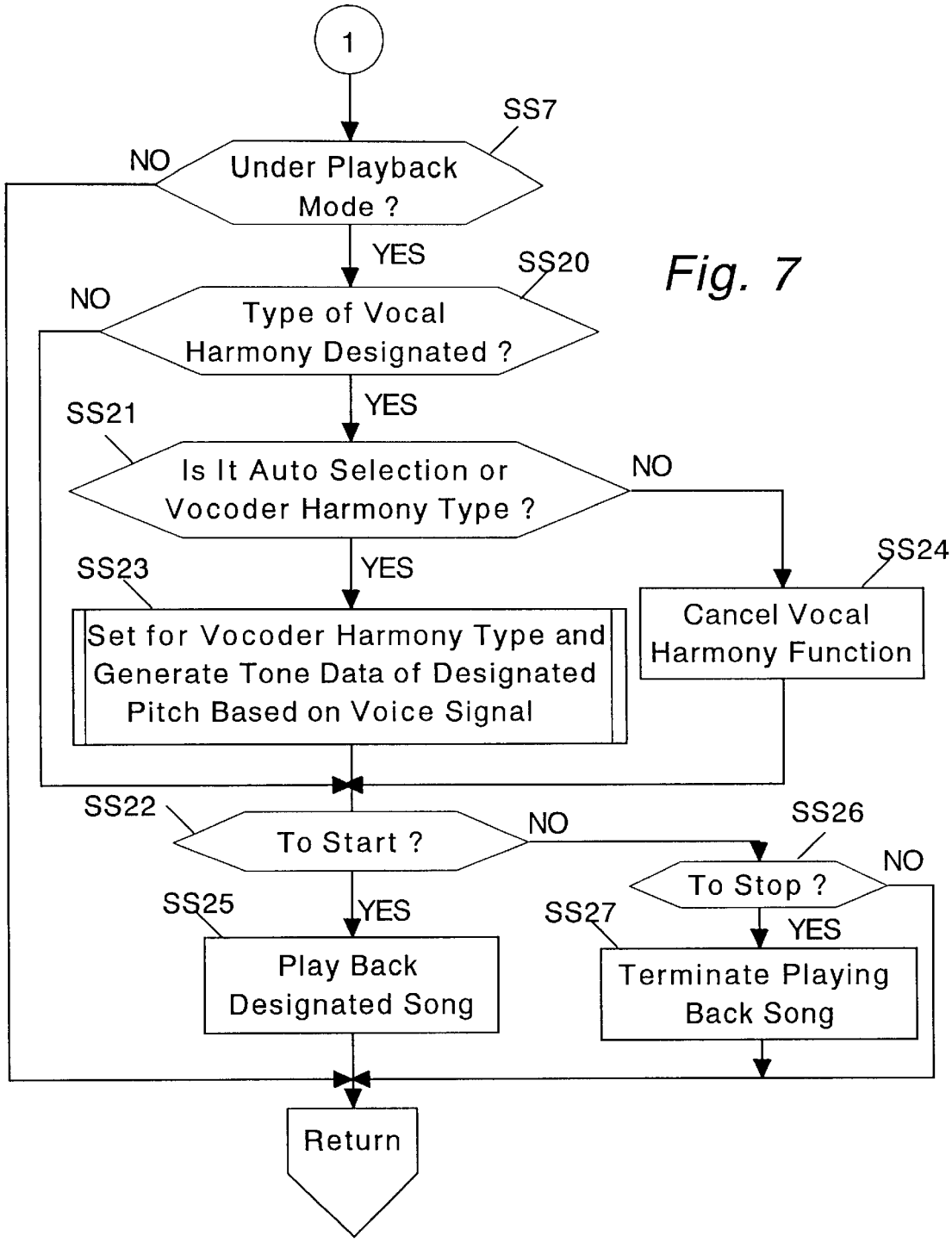

FIGS. 5, 6 and 7 show, in combination, a flow chart of an example of subroutine processing for detecting performance data and generating tone data as executed at the step S3 in the main routine processing of FIG. 2. Steps SS1–SS3 are to detect performance data inputted from plural (three, in this example) kinds of performance sources, respectively detecting performance data from the respectively allotted performance sources. The first step SS1 receives keyboard performance data derived from the keyboard device 4 according to the user's manipulation of the keys in the keyboard and detects the notes as are designated by the user's manipulation. The note designation is utilized in determining the tone pitches of the harmony tones to be generated, and also in producing normal musical performance tones in an intended tone color as on the conventional electronic musical instrument.

The second step SS2 receives automatic performance data read out from the external storage device 10 and detects the notes as are designated by the automatic performance data, if any, while the automatic performance function is rendered operative. These detected automatic performance data are used for determining the tone pitches of the harmony tones to be generated, and the tone pitches of the automatic performance tones in an intended tone color as well. The third step SS3 receives external performance data supplied from the external performance device 17 such as a sequencer, a computer and an electronic musical instrument connected to the apparatus of the present invention via the performance data interface 12 and detects the notes as are designated by the external performance data, if any. The detected external performance data are used for determining the tone pitches of the harmony tones to be generated, and tone pitches of the external performance tones in an intended tone color as well.

A step SS4 detects inputted voice wave signals from the microphone 15 or played back voice wave signals from the record player 16 both connected to the voice signal interface 12. The detected voice wave signals are used to determine the voice (i.e. timbre or tone color) of the harmony voices to be produced. The wave form, the frequency spectrum, the format or other tone color defining factors of the inputted or played back voice wave signals constitute basic reference timbres for establishing the timbre of the harmony voices to be generated. The timbre of the harmony voices may be the same as the reference voices or may be somewhat modified from the reference voices. The original inputted or played back voices may be produced as audible sounds just as by the usual audio apparatus together with the generated harmony voices. Or alternatively, the original voices may be muted so that only the harmony voices shall be sounded. Arbitrary setting will be available.

Accompaniment Mode Processing

A step SS5 judges whether the accompaniment mode is now set. If the judgment is affirmative, the process moves forward to a step SS6, and if negative, the process skips to a step SS7 (in FIG. 7) to go through the play back mode processing thereafter. If the step SS6 detects that the start is commanded, the process goes to a step SS8 for the automatic accompaniment operation. If the start command is not set, the process goes to a step SS9 to judge whether the stop command is issued. If the stop is not commanded, the process skips to the step SS7 (FIG. 7), and if the stop is commanded the process goes forward to a step SS10 to cancel the accompaniment mode.

The step SS8 judges whether the automatic accompaniment is now set to be "on. " If the judgment is affirmative (YES) the process goes to a step SS11 (FIG. 6), and if negative (NO), the process goes forward to a step SS12 to generate rhythm tone data as set, before moving forward to the step SS7 (FIG. 7). In the case of the automatic accompaniment mode (FIG. 6), a preferable vocal harmony is the chordal harmony mode generally. Thus, the step SS11 execute the detection processing of the designated chord from the chord information contained in the performance data from the keyboard device 4, the external storage device 10 and from the external performance device 17 before going to a step SS13. The chord designation by means of the keyboard may be in any conventional fashion. The most popular one may be the fingered mode chord designation in which the chord is designated by designating all the chord constituent notes. An advantageous one especially for the beginners would be the single finger mode chord designation in which one note depressed or the lowest note among a few notes depressed in the leftmost keyboard region (one octave or so) will determine the root note of a chord. The chord designation modes can be arbitrarily set using a chord designation mode selection keys or dial switches. The step SS13 judges whether any type of vocal harmony mode is set. If a type is designated, the process moves forward to a step SS14 to judge which of the types it is. If any of the types is not designated, a step SS15 generates chord data in a designated tone color and a step SS16 generates accompaniment chord tone data to conduct an ordinary chord performance. Then the process moves forward to the step SS7 (FIG. 7). The step SS14 judges whether either of the automatic type selection and the chordal harmony type is set or neither of the two is set. If either of the two is designated, the process goes to a step SS17 to judge whether a chord has been detected yet (at the step SS11), and if the judgment is affirmative (YES), the process goes forward to a step SS18.

The step SS18 is to generate harmony tone data in the set vocal harmony mode, i.e. the chordal type of harmony mode, wherein the generated tone data bears pitch information which designates note pitches of the chord constituent tones of the detected chord with reference to the detected voice signals (at SS4) from the microphone 15 or the record player 16, before going forward to the step SS7 (FIG. 7). Therefore, where the automatic accompaniment mode is designated, the harmony tones to be added to the original inputted or played back voice signals have tone pitches determined by the chord constituent notes of the designated chord in the performance data. In the processing at the step SS18, there may arise a problem that the tone generation channels can be securely assigned for all the harmony tone data which are designated anew one after another in the chordal harmony mode, and some additional processing containing a latest-preferential assignment function may be introduced in the harmony tone generation as will be described hereinafter.

If the judgment at the step SS14 is negative (NO), which means that the vocoder type harmony generation mode is set, or if the judgment at the step SS17 is negative (NO), which means that any chord has been detected, the process moves to a step SS19 to generate harmony tone data in the vocoder type generation mode. For example, where the performance data are inputted from the keyboard, the note pitches as designated by the keys in the right hand fractional region of the keyboard will determine the tone pitches of the harmony tones to be generated under the vocoder mode. The harmony voices finally produced will be with such determined tone pitches and in a timbre (voice) determined by the voice signals inputted from the microphone 15. Also in the processing at the step SS19, an additional processing containing a latest-preferential assignment function will be introduced to secure tone generation channels in the vocoder type harmony generation, as will be described herein later. After the step SS19 comes the step SS7 (FIG. 7).

Playback Mode Processing

Referring to FIG. 7, the step SS7 judges whether the playback mode is now set. If the judgment is affirmative (YES), the process goes to a step SS20, while if the judgment is negative (NO), the process returns to the main routine of FIG. 2 to proceed to the step S4 for the musical sound generation. The step SS20 judges whether any type of vocal harmony mode is set. If a type is designated, the process moves forward to a step SS21 to judge which of the types it is. If none of the types is designated, the process skips to a step SS22. The step SS21 judges whether either of the automatic type selection and the vocoder harmony type is set or neither of the two is set. If either of the two is designated, the process goes to a step SS23 to set the type of the vocal harmony mode to be the vocoder type and conducts the processing for generating vocoder harmony tone data with the designated tone pitches with reference to the voice wave signal inputted from the microphone 15. Also in the processing at the step SS23, an additional processing containing a latest-preferential assignment function will be introduced to secure tone generation channels in the vocoder type harmony generation, as will be described herein later. After the step SS23, the process moves to a step SS22.

Thus, under the playback mode, the step SS23 generates harmony tone data to designate tone pitches for the harmony voices according to the keyboard performance data from the keyboard device 4 representing the depressed keys, the automatic performance data read out from the external storage device 10 or the external performance data from the external performance device 17. The tone pitches of the voice signals inputted from the microphone 15 or played back from the record player 16 will be changed to the pitches as designated by the harmony tone data in the later stage processing, or harmony voices having pitches determined by such harmony tone data will be outputted from the musical sound producing section (8, 9 and 14) in FIG. 1 in addition to the voices of the inputted or played back original wave signals to realize harmonious performance.

The steps SS18 (FIG. 6), SS19 (FIG. 6) and SS23 (FIG. 7) generate vocal harmony tone data according to the parameters as set in detail at the step SV2 in FIG. 4. For example, by applying the gender alteration function to the inputted human voices, the male singer's voices can be changed to female voices or the female singer's voices can be changed to male voices. During the generation of the vocal harmony voices, the harmony voices alone can be sounded, if the level of the inputted voice signal is lowered or muted.

On the contrary to the above description, if the step SS21 judges negative (NO), which means that the harmony mode is set to be a chordal type, the process moves to a step SS24 to cancel the vocal harmony function, before going to the step SS22.

If the step SS22 judges that the start is commanded, the process goes to a step SS25 to conduct processing for playing back the performance data of the designated musical piece (number), and thereafter returns to the main routine of FIG. 2, at the step S4. If the start command is not set, the process goes to a step SS22 to judge whether the stop command is issued. If the stop is not commanded, the process returns back to the main routine of FIG. 2, and if the stop is commanded the process goes forward to a step SS27 to terminate playing back the designated musical piece (number), before returning to the main routine.

Harmony Tone Generation

The music performance system according to an embodiment of the present invention is provided with a plurality of tone generation channels, each for generating tone data of one note. Some of those tone generation channels are for the direct performance tone generation and are selectively assigned among plural kinds of performance data from plural kinds of performance sources to generate the ordinary musical tones as designated by the performance data and in tone colors according to the player's designation. Some other channels are for the harmony tone generation and are separately assigned among plural kinds of performance data from plural kinds of performance sources to generate harmony tone data representing pitches respectively determined by the performance data, which harmony tone data are to be used for determining the tone pitches of the harmony voice signals to be produced by means of the DSP and the associated circuits, while the timbres of the harmony voices are determined by the voices of the inputted reference voice wave signals, for example at the process step S4 in FIG. 2. The steps SS18, SS19 and SS23 may preferably employ assignable tone generation channels of a certain limited number for the harmony tone generation.

If the number of concurrent designations by the performance data are so many that the prepared number of harmony tone generation channels may be smaller than the number of harmony tones to be generated, the latter number being the number of tone designations by the performance data multiplied by the number of harmony tones per tone designation in comparison. Then, there will occur a shortage of available harmony tone channels, i.e. a shortage of resources. To cope with such a situation, the present invention employs a performance data capture module having a latest-arrival preferential function so that, for example, the performance data of the latest two key-on events shall be captured and the performance data of such two notes shall be assigned for the harmony tone generation. If there have been assigned two previous tones when a new note designation has arrived, oldest assigned channel of the two shall be truncated (to stop generation of the oldest assigned note) to be assignable for the new note designation. The generation of the ordinary tone as designated by the performance data per se in a designated tone color will be continued.

Each of the harmony tone generation channels may be automatically designated according to the kind of performance source, or may be individually designated by each piece of performance data.

FIG. 8 shows a flow chart of an example of subroutine processing for generating harmony tones. This subroutine is used at the steps 18(FIG. 6), SS19 (FIG. 6) and SS23 (FIG. 7) in the processing of performance data detection and tone data generation, as there may arise a problem whether a tone generation channel can be secured or not for generating harmony tone generation data in the respective types (chordal at SS18, vocoder at SS19 and SS23) of vocal harmony mode processing.

A step SH1 detects the number of harmony tones now being generated. This is to check how many channels are now available (not-busy), as there are provided a limited number of channels for harmony tone generation. A step SH2 judge whether there is any available channels left for the harmony tone generation. If the number of available channels is greater than the number of harmony tones to be generated anew according to the performance data supplied, ie. the judgment is affirmative (YES), then the process moves to a step SH3 for harmony tone generation.

On the other hand, in case there is no available channel left for new assignment, i.e. the judgment is negative (NO), the process moves to a step SH4 to truncate the harmony tones now being generated partly or wholly according to a predetermined condition. The priority in truncation is on the "oldest-generation, first truncation" basis. After truncating the oldest occupied channel(s) to secure available channel(s) for new harmony tone(s), the process moves forward to the step SH3. The step SH3 generates harmony tone data for the newly assigned performance data under the vocal harmony mode using an available channel (whether available from before or just now by truncation). Thus, the vocal harmony tones will be generated on the latest arrival preferred basis.

Where two harmony tones, for example, are being generated in response to one designation by the performance data (i.e. two harmony tone per note of captured performance data) and all the harmony tone generation channels are occupied, and there comes a new captured note of performance data, two harmony tone generation channels assigned to the oldest captured note will be truncated, i.e. canceled and made available for two new harmony tones in response to one latest captured performance note. The step SH3 generates such two new harmony tones using the now made-available channels. If the number of available channel (e.g. one) is smaller than the number of harmony tones (e.g. two) to be generated in response to one newly captured note, then one of the two channels which have been assigned to the oldest one of the captured notes will be truncated according to a predetermined preference condition, for example, by truncating the channel in charge of the higher tone of the two harmony tones.

In the case where a plurality of harmony tones are generated in response to one note as designated by the performance data, the number of the latest arrived notes to be kept captured among the performance data will be calculated by dividing "the number of harmony tone generation channels" by "the number of harmony tones to be generated per capture." Further, in the case where harmony tones are generated in response to performance data from plural kinds of performance sources and where there arises a necessity of truncating a part of the harmony tones being generated in order to prepare for the generation of harmony tone(s) in response to a newly captured note, the truncation will be conducted according to a predetermined priority order among different kinds of performance sources to allot the truncated channel for the newly captured performance data. If a harmony tone of a certain tone pitch is being generated in response to a certain performance data piece, and there comes another performance data piece which designates a harmony tone of the same tone pitch, the generation of the former harmony tone will be continued.

According to the present invention, plural performance data pieces defining plural performed notes from various kinds of performance sources are captured on a latest-preference basis, and the harmony tone data and hence the harmony voice wave signals are generated in response to the captured performance data. Thus, harmony tones will be generated in response to the performance data from at least two different kinds of performance devices such as a keyboard, an automatic performance data storage and an external performance device, according to a simple selection rule of latest-preference from among those performance sources.

Alternative Embodiments

As will be understood from the foregoing description, the term "harmony tone" and "harmony voice" will cover not only a tone or voice which is sounded simultaneously with another reference tone or voice, but also a tone or voice which is sounded alone, because such a tone or voice may be afterward used to be sounded together with some other tones or voices. Further, the present invention is applicable in generating any other tones or voices than the ordinary tones or voices being generated by direct designation by the performance data as in the conventional musical apparatus.

The present invention is advantageous in using for generating human harmony voices to be concurrently sounded with human song voices by inputting human voices as the reference voice. The vocal harmony tones and voices are generated in response to different kinds of performance devices including not only a keyboard, but also an automatic performance device and an external performance device.

While particular embodiments of the invention have been described, it will, of course, be understood by those skilled in the art without departing from the spirit of the present invention so that the invention is not limited thereto, since modifications may be made by those skilled in the art, particularly in light of the foregoing teachings. It is therefore contemplated by the appended claims to cover any such modifications that incorporate those features of these improvements in the true spirit and scope of the invention.

Performance Data Detection & Tone Data Generation

FIGS. 5, 6 and 7 show, in combination, a flow chart of an example of subroutine processing for detecting performance data and generating tone data as executed at the step S3 in the main routine processing of FIG. 2. Steps SS1–SS3 are to detect performance data inputted from plural (three, in this example) kinds of performance sources, respectively detecting performance data from the respectively allotted performance sources. The first step SS1 receives keyboard performance data derived from the keyboard device 4 according to the user's manipulation of the keys in the keyboard and detects the notes as are designated by the user's manipulation. The note designation is utilized in determining the tone pitches of the harmony tones to be generated, and also in producing normal musical performance tones in an intended tone color as on the conventional electronic musical instrument.

The second step SS2 receives automatic performance data read out from the external storage device 10 and detects the notes as are designated by the automatic performance data, if any, while the automatic performance function is rendered operative. These detected automatic performance data are used for determining the tone pitches of the harmony tones to be generated, and the tone pitches of the automatic performance tones in an intended tone color as well. The third step SS3 receives external performance data supplied from the external performance device 17 such as a sequencer, a computer and an electronic musical instrument connected to the apparatus of the present invention via the performance data interface 12 and detects the notes as are designated by the external performance data, if any. The detected external performance data are used for determining the tone pitches of the harmony tones to be generated, and tone pitches of the external performance tones in an intended tone color as well.

A step SS4 detects inputted voice wave signals from the microphone 15 or played back voice wave signals from the record player 16 both connected to the voice signal interface 12. The detected voice wave signals are used to determine the voice (i.e. timbre or tone color) of the harmony voices to be produced. The wave form, the frequency spectrum, the format or other tone color defining factors of the inputted or played back voice wave signals constitute basic reference timbres for establishing the timbre of the harmony voices to be generated. The timbre of the harmony voices may be the same as the reference voices or may be somewhat modified from the reference voices. The original inputted or played back voices may be produced as audible sounds just as by the usual audio apparatus together with the generated harmony voices. Or alternatively, the original voices may be muted so that only the harmony voices shall be sounded. Arbitrary setting will be available.

Accompaniment Mode Processing

A step SS5 judges whether the accompaniment mode is now set. If the judgment is affirmative, the process moves forward to a step SS6, and if negative, the process skips to a step SS7 (in FIG. 7) to go through the play back mode processing thereafter. If the step SS6 detects that the start is commanded, the process goes to a step SS8 for the automatic accompaniment operation. If the start command is not set, the process goes to a step SS9 to judge whether the stop command is issued. If the stop is not commanded, the process skips to the step SS7 (FIG. 7), and if the stop is commanded the process goes forward to a step SS10 to cancel the accompaniment mode.

The step SS8 judges whether the automatic accompaniment is now set to be "on." If the judgment is affirmative (YES) the process goes to a step SS11 (FIG. 6), and if negative (NO), the process goes forward to a step SS12 to generate rhythm tone data as set, before moving forward to the step SS7 (FIG. 7). In the case of the automatic accompaniment mode (FIG. 6), a preferable vocal harmony is the chordal harmony mode generally. Thus, the step SS11 execute the detection processing of the designated chord from the chord information contained in the performance data from the keyboard device 4, the external storage device 10 and from the external performance device 17 before going to a step SS13. The chord designation by means of the keyboard may be in any conventional fashion. The most popular one may be the fingered mode chord designation in which the chord is designated by designating all the chord constituent notes. An advantageous one especially for the beginners would be the single finger mode chord designation in which one note depressed or the lowest note among a few notes depressed in the leftmost keyboard region (one octave or so) will determine the root note of a chord. The chord designation modes can be arbitrarily set using a chord designation mode selection keys or dial switches.

The step SS13 judges whether any type of vocal harmony mode is set. If a type is designated, the process moves forward to a step SS14 to judge which of the types it is. If any of the types is not designated, a step SS15 generates chord data in a designated tone color and a step SS16 generates accompaniment chord tone data to conduct an ordinary chord performance. Then the process moves forward to the step SS7 (FIG. 7). The step SS14 judges whether either of the automatic type selection and the chordal harmony type is set or neither of the two is set. If either of the two is designated, the process goes to a step SS17 to judge whether a chord has been detected yet (at the step SS11), and if the judgment is affirmative (YES), the process goes forward to a step SS18.

The step SS18 is to generate harmony tone data in the set vocal harmony mode, i.e. the chordal type of harmony mode, wherein the generated tone data bears pitch information which designates note pitches of the chord constituent tones of the detected chord with reference to the detected voice signals (at SS4) from the microphone 15 or the record player 16, before going forward to the step SS7 (FIG. 7). Therefore, where the automatic accompaniment mode is designated, the harmony tones to be added to the original inputted or played back voice signals have tone pitches determined by the chord constituent notes of the designated chord in the performance data. In the processing at the step SS18, there may arise a problem that the tone generation channels can be securely assigned for all the harmony tone data which are designated anew one after another in the chordal harmony mode, and some additional processing containing a latest-preferential assignment function may be introduced in the harmony tone generation as will be described hereinafter.

If the judgment at the step SS14 is negative (NO), which means that the vocoder type harmony generation mode is set, or if the judgment at the step SS17 is negative (NO), which means that any chord has been detected, the process moves to a step SS19 to generate harmony tone data in the vocoder type generation mode. For example, where the performance data are inputted from the keyboard, the note pitches as designated by the keys in the right hand fractional region of the keyboard will determine the tone pitches of the harmony tones to be generated under the vocoder mode. The harmony voices finally produced will be with such determined tone pitches and in a timbre (voice) determined by the voice signals inputted from the microphone 15. Also in the processing at the step SS19, an additional processing containing a latest-preferential assignment function will be introduced to secure tone generation channels in the vocoder type harmony generation, as will be described herein later. After the step SS19 comes the step SS7 (FIG. 7).

Playback Mode Processing

Referring to FIG. 7, the step SS7 judges whether the playback mode is now set. If the judgment is affirmative (YES), the process goes to a step SS20, while if the judgment is negative (NO), the process returns to the main routine of FIG. 2 to proceed to the step S4 for the musical sound generation. The step SS20 judges whether any type of vocal harmony mode is set. If a type is designated, the process moves forward to a step SS21 to judge which of the types it is. If none of the types is designated, the process skips to a step SS22. The step SS21 judges whether either of the automatic type selection and the vocoder harmony type is set or neither of the two is set. If either of the two is designated, the process goes to a step SS23 to set the type of the vocal harmony mode to be the vocoder type and conducts the processing for generating vocoder harmony tone data with the designated tone pitches with reference to the voice wave signal inputted from the microphone 15. Also in the processing at the step SS23, an additional processing containing a latest-preferential assignment function will be introduced to secure tone generation channels in the vocoder type harmony generation, as will be described herein later. After the step SS23, the process moves to a step SS22.

Thus, under the playback mode, the step SS23 generates harmony tone data to designate tone pitches for the harmony voices according to the keyboard performance data from the keyboard device 4 representing the depressed keys, the automatic performance data read out from the external storage device 10 or the external performance data from the external performance device 17. The tone pitches of the voice signals inputted from the microphone 15 or played back from the record player 16 will be changed to the pitches as designated by the harmony tone data in the later stage processing, or harmony voices having pitches determined by such harmony tone data will be outputted from the musical sound producing section (8, 9 and 14) in FIG. 1 in addition to the voices of the inputted or played back original wave signals to realize harmonious performance.

The steps SS18 (FIG. 6), SS19 (FIG. 6) and SS23 (FIG. 7) generate vocal harmony tone data according to the parameters as set in detail at the step SV2 in FIG. 4. For example, by applying the gender alteration function to the inputted human voices, the male singer's voices can be changed to female voices or the female singer's voices can be changed to male voices. During the generation of the vocal harmony voices, the harmony voices alone can be sounded, if the level of the inputted voice signal is lowered or muted.

On the contrary to the above description, if the step SS21 judges negative (NO), which means that the harmony mode is set to be a chordal type, the process moves to a step SS24 to cancel the vocal harmony function, before going to the step SS22.

If the step SS22 judges that the start is commanded, the process goes to a step SS25 to conduct processing for playing back the performance data of the designated musical piece (number), and thereafter returns to the main routine of FIG. 2, at the step S4. If the start command is not set, the process goes to a step SS22 to judge whether the stop command is issued. If the stop is not commanded, the process returns back to the main routine of FIG. 2, and if the stop is commanded the process goes forward to a step SS27 to terminate playing back the designated musical piece (number), before returning to the main routine.

Harmony Tone Generation

The music performance system according to an embodiment of the present invention is provided with a plurality of tone generation channels, each for generating tone data of one note. Some of those tone generation channels are for the direct performance tone generation and are selectively assigned among plural kinds of performance data from plural kinds of performance sources to generate the ordinary musical tones as designated by the performance data and in tone colors according to the player's designation. Some other channels are for the harmony tone generation and are separately assigned among plural kinds of performance data from plural kinds of performance sources to generate harmony tone data representing pitches respectively determined by the performance data, which harmony tone data are to be used for determining the tone pitches of the harmony voice signals to be produced by means of the DSP and the associated circuits, while the timbres of the harmony voices are determined by the voices of the inputted reference voice wave signals, for example at the process step S4 in FIG. 2. The steps SS18, SS19 and SS23 may preferably employ assignable tone generation channels of a certain limited number for the harmony tone generation.

If the number of concurrent designations by the performance data are so many that the prepared number of harmony tone generation channels may be smaller than the number of harmony tones to be generated, the latter number being the number of tone designations by the performance data multiplied by the number of harmony tones per tone designation in comparison. Then, there will occur a shortage of available harmony tone channels, i.e. a shortage of resources. To cope with such a situation, the present invention employs a performance data capture module having a latest-arrival preferential function so that, for example, the performance data of the latest two key-on events shall be captured and the performance data of such two notes shall be assigned for the harmony tone generation. If there have been assigned two previous tones when a new note designation has arrived, oldest assigned channel of the two shall be truncated (to stop generation of the oldest assigned note) to be assignable for the new note designation. The generation of the ordinary tone as designated by the performance data per se in a designated tone color will be continued.

Each of the harmony tone generation channels may be automatically designated according to the kind of performance source, or may be individually designated by each piece of performance data.

FIG. 8 shows a flow chart of an example of subroutine processing for generating harmony tones. This subroutine is used at the steps SS18 (FIG. 6), SS19 (FIG. 6) and SS23 (FIG. 7) in the processing of performance data detection and tone data generation, as there may arise a problem whether a tone generation channel can be secured or not for generating harmony tone generation data in the respective types (chordal at SS18, vocoder at SS19 and SS23) of vocal harmony mode processing.

A step SH1 detects the number of harmony tones now being generated. This is to check how many channels are now available (not-busy), as there are provided a limited number of channels for harmony tone generation. A step SH2 judge whether there is any available channels left for the harmony tone generation. If the number of available channels is greater than the number of harmony tones to be generated anew according to the performance data supplied, i.e. the judgment is affirmative (YES), then the process moves to a step SH3 for harmony tone generation.

On the other hand, in case there is no available channel left for new assignment, i.e. the judgment is negative (NO), the process moves to a step SH4 to truncate the harmony tones now being generated partly or wholly according to a predetermined condition. The priority in truncation is on the "oldest-generation, first truncation" basis. After truncating the oldest occupied channel(s) to secure available channel(s) for new harmony tone(s), the process moves forward to the step SH3. The step SH3 generates harmony tone data for the newly assigned performance data under the vocal harmony mode using an available channel (whether available from before or just now by truncation). Thus, the vocal harmony tones will be generated on the latest arrival preferred basis.

Where two harmony tones, for example, are being generated in response to one designation by the performance data (i.e. two harmony tone per note of captured performance data) and all the harmony tone generation channels are occupied, and there comes a new captured note of performance data, two harmony tone generation channels assigned to the oldest captured note will be truncated, i.e. canceled and made available for two new harmony tones in response to one latest captured performance note. The step SH3 generates such two new harmony tones using the now made-available channels. If the number of available channel (e.g. one) is smaller than the number of harmony tones (e.g. two) to be generated in response to one newly captured note, then one of the two channels which have been assigned to the oldest one of the captured notes will be truncated according to a predetermined preference condition, for example, by truncating the channel in charge of the higher tone of the two harmony tones.

In the case where a plurality of harmony tones are generated in response to one note as designated by the performance data, the number of the latest arrived notes to be kept captured among the performance data will be calculated by dividing "the number of harmony tone generation channels" by "the number of harmony tones to be generated per capture." Further, in the case where harmony tones are generated in response to performance data from plural kinds of performance sources and where there arises a necessity of truncating a part of the harmony tones being generated in order to prepare for the generation of harmony tone(s) in response to a newly captured note, the truncation will be conducted according to a predetermined priority order among different kinds of performance sources to allot the truncated channel for the newly captured performance data. If a harmony tone of a certain tone pitch is being generated in response to a certain performance data piece, and there comes another performance data piece which designates a harmony tone of the same tone pitch, the generation of the former harmony tone will be continued.

According to the present invention, plural performance data pieces defining plural performed notes from various kinds of performance sources are captured on a latest-preference basis, and the harmony tone data and hence the harmony voice wave signals are generated in response to the captured performance data. Thus, harmony tones will be generated in response to the performance data from at least two different kinds of performance devices such as a keyboard, an automatic performance data storage and an external performance device, according to a simple selection rule of latest-preference from among those performance sources.

Alternative Embodiments

As will be understood from the foregoing description, the term "harmony tone" and "harmony voice" will cover not only a tone or voice which is sounded simultaneously with another reference tone or voice, but also a tone or voice which is sounded alone, because such a tone or voice may be afterward used to be sounded together with some other tones or voices. Further, the present invention is applicable in generating any other tones or voices than the ordinary tones or voices being generated by direct designation by the performance data as in the conventional musical apparatus.

The present invention is advantageous in using for generating human harmony voices to be concurrently sounded with human song voices by inputting human voices as the reference voice. The vocal harmony tones and voices are generated in response to different kinds of performance devices including not only a keyboard, but also an automatic performance device and an external performance device.

While particular embodiments of the invention have been described, it will, of course, be understood by those skilled in the art without departing from the spirit of the present invention so that the invention is not limited thereto, since modifications may be made by those skilled in the art, particularly in light of the foregoing teachings. It is therefore contemplated by the appended claims to cover any such modifications that incorporate those features of these improvements in the true spirit and scope of the invention.

What is claimed is:

1. A harmony tone generating apparatus comprising:

a voice signal input module which receives a voice wave signal bearing tone pitches;

a performance data input module which receives plural kinds of performance data from plural kinds of performance sources, said performance data containing plural data pieces, each defining a musical note having a pitch;

a performance data capture module which captures a performance data piece that has been received latest among said data pieces contained in said performance data received from said plural kinds of performance sources; and a harmony tone data generating module which generates harmony tone data representing a tone pitch determined by the note pitch defined by said data piece as captured by said performance data capture module to be used for generation of harmony voice signal with respect to said received voice wave signal.

2. A harmony tone generating apparatus as claimed in claim 1, further comprising a harmony voice signal generating module which generates a harmony voice wave signal having a voice quality determined by said received voice wave signal and having a tone pitch determined by said harmony tone data.

3. A harmony tone generating apparatus as claimed in claim 1, further comprising performance tone generating channels, each for generating a performance data piece representing a performance tone having a note pitch defined by said data piece, and wherein said harmony tone generating module comprises at least one harmony tone data generating channel for generating harmony tone data other than said performance tone generating channels.

4. A harmony tone generating apparatus as claimed in claim 1, wherein said harmony tone data generating module further includes a pitch shift module for generating harmony tone data having a pitch which is determined by shifting the tone pitch of said voice wave signal by a predetermined amount of pitch interval.

5. A harmony tone generating apparatus as claimed in claim 1, further comprising: a performance source specifying module which specifies the performance source from which said performance data are to be received.

6. A harmony tone generating apparatus as claimed in claim 5, wherein each of said data pieces of performance data has an identifier, and said performance source specifying module specifies tie performance source according to said identifier.

7. A harmony tone generating apparatus as claimed in claim 1, further comprising a storage device which stores automatic performance data as a kind of said performance sources, wherein said plural kinds of performance data from plural kinds of performance sources includes at least said automatic performance data from said storage device.

8. A harmony tone generating apparatus as claimed in claim 1, wherein said plural kinds of performance data from plural kinds of performance sources includes at least performance data from an external device connected to said harmony tone generating apparatus.

9. A harmony tone generating apparatus as claimed in claim 1, further comprising a manipulating device for a user to perform music therewith to provide manipulatory performance data as a kind of said performance source, wherein said plural kinds of performance data from plural kinds of performance sources includes at least said manipulatory performance data from said manipulating device.

10. A harmony tone generating apparatus as claimed in claim 1, wherein said harmony tone generating module comprises a number of harmony tone generating channels, each for generating a harmony tone data piece defining a tone pitch, and a channel assigner which assigns the latest captured performance data piece to an available one of said harmony tone generating channels for the generation of said harmony tone data when there is an available channel left and which truncates the oldest assigned one of said harmony tone generating channels when there is no available channel left for a new assignmnent to prepare for said new assignment.

11. A harmony tone generating apparatus as claimed in claim 1, wherein said harmony tone data generating module comprises a first number of harmony tone generating channels, each for generating a harmony tone data piece defining a tone pitch; a second number of said harmony tone data generating channels are assigned to generate harmony tone data per captured performance data piece, said second number being smaller than said first number; and thus said harmony tone data generating module generates harmony tone data responsive to a third number of said captured performance data piece, said third number being such a number as is obtained by dividing said first number by said second number.

12. A storage medium for use in an apparatus for generating harmony tones, said apparatus being of a data processing type comprising a computer, said medium containing a program that is executable by the computer, the program comprising:

a module of receiving a voice wave signal bearing tone pitches;

a module of receiving plural kinds of performance data from plural kids of performance sources, said performance data containing plural data pieces, each defining a musical note having a pitch;

a module of capturing a performance data piece that has been received latest among said data pieces contained in said performance data received from said plural kinds of performance sources; and a module of generating harmony tone data representing a tone pitch determined by the note pitch defined by said data piece as captured by said performance data capture module to be used for generation of harmony voice signal with respect to said received voice wave signal.

13. A program containing storage medium as claimed in claim 12, wherein said module of generating harmony tone data provides a first number of harmony tone generating channels, each for generating harmony tone data piece defining a tone pitch; assigns a second number of said harmony tone generating channels to generate harmony tone data per data piece in said performance data, said second number being smaller to said first number; and generates harmony tone data responsive to a third number of said captured performance data piece, said third number being such a number as is obtained by dividing said first number by said second number.

14. A method for generating harmony tones comprising:

a step of receiving a voice wave signal bearing tone pitches;

a step of receiving plural kinds of performance data from plural kinds of performance sources, said performance data comprising plural data pieces, each defining a musical note having a pitch, a step of capturing a performance data piece that has been received latest among said data pieces contained in said performance data received from said plural kinds of performance sources; and a step of generating harmony tone data representing a tone pitch determined by the note pitch defined by said data piece as captured by said performance data capture module to be used for generation of harmony voice signal with respect to said received voice wave signal.

15. A harmony tone generating method as claimed in claim 14, wherein said step of generating harmony tone data provides a first number of harmony tone generating channels, each for generating harmony tone data piece defining a tone pitch; assigns a second number of said harmony tone generating channels to generate harmony tone data per data piece in said performance data, said second number being smaller than said first number; and generates harmony tone data responsive to a third number of said captured performance data piece, said third number being such a number as is obtained by dividing said first number by said second number.

16. A harmony tone generating apparatus as claimed in claim 1, wherein said plural kinds of performance data from plural kinds of performance sources include performance data obtained by a direct real-time performance on a keyboard device having manipulating keys and performance data obtained by reading out recorded performance data from an automatic performance data storage device.

17. A harmony tone generating apparatus as claimed in claim 1, wherein said plural kinds of performance data from plural kinds of performance sources include performance data obtained by a direct real-time performance on a keyboard device having manipulating keys and performance data received from an external musical apparatus connected to the harmony tone generating apparatus.

18. A program containing storage medium as claimed in claim 12, wherein said plural kinds of performance data from plural kinds of performance sources include performance data obtained by a direct real-time performance on a keyboard device having manipulating keys and performance data obtained by reading out recorded performance data from an automatic performance data storage device.

19. A program containing storage medium as claimed in claim 12, wherein said plural kinds of performance data from plural kinds of performance sources include performance data obtained by a direct real-time performance on a keyboard device having manipulating keys and performance data received from an external musical apparatus connected to the harmony tone generating apparatus.

20. A harmony tone generating method as claimed in claim 14, wherein said plural kinds of performance data from plural kinds of performance sources include performance data obtained by a direct real-time performance on a keyboard device having manipulating keys and performance data obtained by reading out recorded performance data from an automatic performance data storage device.

21. A harmony tone generating method as claimed in claim 14, wherein said plural kinds of performance data from plural kinds of performance sources include performance data obtained by a direct real-time performance on a keyboard device having manipulating keys and performance data received from an external musical apparatus connected to the harmony tone generating apparatus.

* * * * *